US006711370B2

(12) United States Patent
Park et al.

(10) Patent No.: US 6,711,370 B2
(45) Date of Patent: Mar. 23, 2004

(54) LIQUID ELECTROPHOTOGRAPHIC IMAGE FORMING APPARATUS

(75) Inventors: Woo-yong Park, Gyeonggi-do (KR); Young-ha No, Gyeonggi-do (KR); Kwang-ho No, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/395,107

(22) Filed: Mar. 25, 2003

(65) Prior Publication Data

US 2004/0005173 A1 Jan. 8, 2004

(30) Foreign Application Priority Data

Jul. 6, 2002 (KR) ..... 10-2002-0039151

(51) Int. Cl.[7] ..... G03G 15/10

(52) U.S. Cl. ..... 399/237; 399/238; 399/239

(58) Field of Search ..... 399/237, 238, 399/239, 249, 250; 222/DIG. 1

(56) References Cited

U.S. PATENT DOCUMENTS 5,153,659 A * 10/1992 Maiefski et al. ..... 399/237
6,108,508 A 8/2000 Takeuchi et al.

* cited by examiner

*Primary Examiner*—Hoang Ngo
(74) *Attorney, Agent, or Firm*—Staas & Halsey LLP

(57) ABSTRACT

A liquid image forming apparatus including a developing portion in which ink is maintained at a uniform level so that the developing roller is dipped at a predetermined level, an ink reservoir in which ink supplied to the developing portion is stored, and an ink supplying unit to supply ink stored in the ink reservoir to the developing portion. The developing portion and the ink reservoir are provided in one developing container, and the ink supplying unit which supplies ink to the developing portion from the ink reservoir is provided in the liquid image forming apparatus.

23 Claims, 6 Drawing Sheets

LIQUID ELECTROPHOTOGRAPHIC IMAGE FORMING APPARATUS

CROSS-REFERENCE TO RELATED APPLICATIONS

This application claims the benefit of Korean Application No. 2002-39151 filed Jul. 6, 2002, in the Korean Intellectual Property Office, the disclosure of which is incorporated herein by reference.

BACKGROUND OF THE INVENTION

1. Field of the Invention

The present invention relates to a liquid electrophotographic image forming apparatus, and more particularly, to a liquid electrophotographic image forming apparatus in which a developer, to develop an image formed on a photosensitive body and an ink reservoir to supply ink to the developer are formed monolithically.

2. Description of the Related Art

In general, electrophotographic image forming apparatuses form an electrostatic latent image on a photosensitive medium, such as a photosensitive drum or photosensitive belt, develop the electrostatic latent image by a developing agent of a predetermined color, and transfer the developed image onto a sheet of paper, thereby forming a desired image.

Such electrophotographic image forming apparatuses are classified into a dry type and a wet type according to the type of the developing agent. Dry type image forming apparatuses use toner in a powder state, while liquid image forming apparatuses use a liquid developing agent, in which the toner is mixed with a volatile liquid carrier. The liquid image forming apparatuses have better printing quality than the dry type image forming apparatuses and reduce the risks of health problems caused by harmful toner dust.

FIG. 1 schematically shows the structure of a conventional liquid color image forming apparatus.

Referring to FIG. 1, a plurality of image forming units are arranged serially along a circulation route of a transfer belt 40, which moves on an endless track by a plurality of rollers 41, 42, and 44. Each of the image forming units transfers cyan (C), magenta (M), yellow (Y), and black (K) images, respectively, onto the transfer belt 40.

Each image forming unit includes a photosensitive drum 30, which transfers a toner image of a predetermined color onto the transfer belt 40; a charger 36, which charges the surface of the photosensitive drum 30 at a predetermined electric potential; a laser scanning unit (LSU) 38, which forms an electrostatic latent image by radiating light onto the charged surface of the photosensitive drum 30; a developing unit 10, which develops the electrostatic latent image into a predetermined toner image; and a cleaning blade 32, which removes a developing agent remaining on the photosensitive drum 30 after the developed toner image is transferred onto the transfer belt 40. Reference numeral 34 denotes an eraser that erases an electric potential on the photosensitive drum 30.

When the transfer belt 40 is supported and rotated by a driving roller 41, a second transfer backup roller 44 and a plurality of first transfer backup rollers 42 corresponding to the photosensitive drum 30, the image that is formed on the photosensitive drum 30 is transferred onto the transfer belt 40. A second transfer roller 43 is installed to rotate in a direction opposite to the rotation of the second transfer backup roller 44, and the transfer belt 40 is placed between the second transfer backup roller 44 and the second transfer roller 43. The second transfer roller 43 transfers the image on the transfer belt 40 onto a sheet of paper 60.

The paper 60 onto which the color image is transferred by the second transfer roller 43 is heated at a predetermined temperature and pressurized by a fusing unit 50 installed on a paper ejecting route, and the toner image is fixed on the paper 60.

FIG. 2 shows a detailed diagram of the image forming unit of FIG. 1 and illustrates a magenta developing unit 10-M among developing units having the same structure of FIG. 1.

Referring to FIG. 2, the developing unit 10 includes a developing portion 11, an ink reservoir 12 in which ink supplied to the developing portion 11 is stored, and a circulating portion 13 which circulates ink between the developing portion 11 and the ink reservoir 12.

The developing portion 11 includes a developing container 14 in which a developing agent (hereinafter, referred to as ink) is stored; a developing roller 15, part of which is dipped in the developing agent and installed to face the photosensitive drum 30; a depositing roller 16; a cleaning roller 17; and a metering roller 18.

Part of the developing roller 15 is dipped in the developing agent stored in the developing container 14. The depositing roller 16 is dipped in the developing agent stored in the developing container 14, and a predetermined voltage is applied to the depositing roller 16 being spaced apart from the developing roller 15 by a predetermined gap. The depositing roller 16 deposits the developing agent onto the surface of the developing roller 15 utilizing a difference in an electric potential between the depositing roller 16 and the developing roller 15 having the predetermined voltage.

The metering roller 18 is installed to be adjacent to the developing roller 15 and regulates the developing agent placed on the developing roller 15 to a predetermined thickness.

An ink feed hole 19 and an ink exhaust hole 20 are provided in the developing container 14. The circulating portion 13 includes an ink feed route 21 that connects the ink reservoir 12 to the ink feed hole 19 of the developing container 14, and an ink withdrawal route 22 that connects the ink reservoir 12 to the ink exhaust hole 20 of the developing container 14. A pump 23 is installed on the ink feed route 21.

Ink withdrawn from the ink reservoir 12 by the pump 23 is supplied to the developing container 14 via the ink feed route 21 connected to the ink feed hole 19. Since the developing agent in the developing container 14 is maintained at a uniform level, ink that exceeds this level is withdrawn to the ink reservoir 12 via the ink withdrawal route 22 connected to the ink exhaust hole 20.

According to the above-mentioned structure, ink withdrawn from the ink reservoir 12 passes through the ink feed route 21, the developing container 14, and the ink withdrawal route 22, back to the ink reservoir 12.

However, according to the structure of FIG. 2, an additional ink reservoir 12 is needed to supply ink to the developing portion 11, a hose is required to form an ink circulation route between the ink reservoir 12 and the developing container 14, and the pump 23 is used to supply ink, thereby increasing the volume of the image forming apparatus. In addition, the hose may be clogged by ink. Thus, when replacing the hose or ink reservoir 12 with another one, it is difficult to attach and detach a coupler (not shown) to and from the hose or ink reservoir 12, and accordingly, ink may leak out of the unit.

SUMMARY OF THE INVENTION

Accordingly, it is an aspect of the present invention to provide a liquid image forming apparatus in which a developing portion and an ink reservoir are formed monolithically and a unit to supply ink to the developing portion.

Additional aspects and/or advantages of the invention will be set forth in part in the description which follows and, in part, will be obvious from the description, or may be learned by practice of the invention.

The foregoing and/or other aspects of the present invention are achieved by providing a liquid image forming apparatus comprising: a developing portion in which a developing roller to develop an electrostatic latent image formed on a photosensitive body in a predetermined color is installed and which is maintained at a uniform level so that the developing roller is dipped at a predetermined level; an ink reservoir in which ink supplied to the developing portion is stored; and an ink supplying unit that supplies ink stored in the ink reservoir to the developing portion. The developing portion and the ink reservoir are provided in one developing container. The ink supplying unit includes a barrier wall by which the developing container is divided into the developing portion and the ink reservoir and a lower part of which is opened, and an ink supplying roller which is installed to contact the lower part of the barrier wall and a bottom surface of the developing container and supplies ink in the ink reservoir to the developing portion.

The ink supplying roller is compressed by a lower end of the barrier wall, passes through the lower end of the barrier wall, expands, absorbs ink in the ink reservoir, meets the lower end of the barrier wall and is compressed when rotating, and ejects ink in the developing portion.

The apparatus further includes a protrusion which projects to correspond to the ink supplying roller in a direction of the barrier wall and is formed to compress an outer surface of the ink supplying roller on the bottom surface of the developing container contacting the ink supplying roller, and wherein the ink supplying roller passes through the protrusion, expands, absorbs ink in the ink reservoir, meets the protrusion and is compressed when rotating, and ejects ink in the developing portion.

In an aspect of the invention, an elastic porous material is formed on the outer surface of the ink supplying roller.

The apparatus further includes a photosensitive drum on which an electrostatic latent image developed by the developing roller is formed, an eraser which erases an electric potential on the photosensitive drum, and an exposing unit which forms an electrostatic latent image on the erased photosensitive drum. The above elements are provided in the developing container and form a single image forming unit.

The foregoing and/or other aspects of the present invention may also be achieved by providing a liquid image forming apparatus comprising: a developing portion in which a developing roller that develops an electrostatic latent image formed on a photosensitive body in a predetermined color is installed and which is maintained at a uniform level so that the developing roller is dipped at a predetermined level, an ink reservoir in which ink supplied to the developing portion is stored, and an ink supplying unit that supplies ink stored in the ink reservoir to the developing portion. In an aspect of the present invention, the developing portion and the ink reservoir are provided in one developing container. The ink supplying unit includes a barrier wall by which the developing container is divided into the developing portion and the ink reservoir and a lower part of which is opened, a cylindrical casing, upper and lower parts of which are fixed between the lower part of the barrier wall and a bottom surface of the developing container, having openings at both sides formed to face the developing portion and the ink reservoir, respectively, an axis eccentric in the cylindrical casing, and a plurality of impellers, one end of each impeller being fixed on the eccentric axis.

In another aspect of the invention, the eccentric axis is eccentric in the casing in a direction of the developing portion.

In yet another aspect of the invention, the impellers are formed of elastic rubber.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
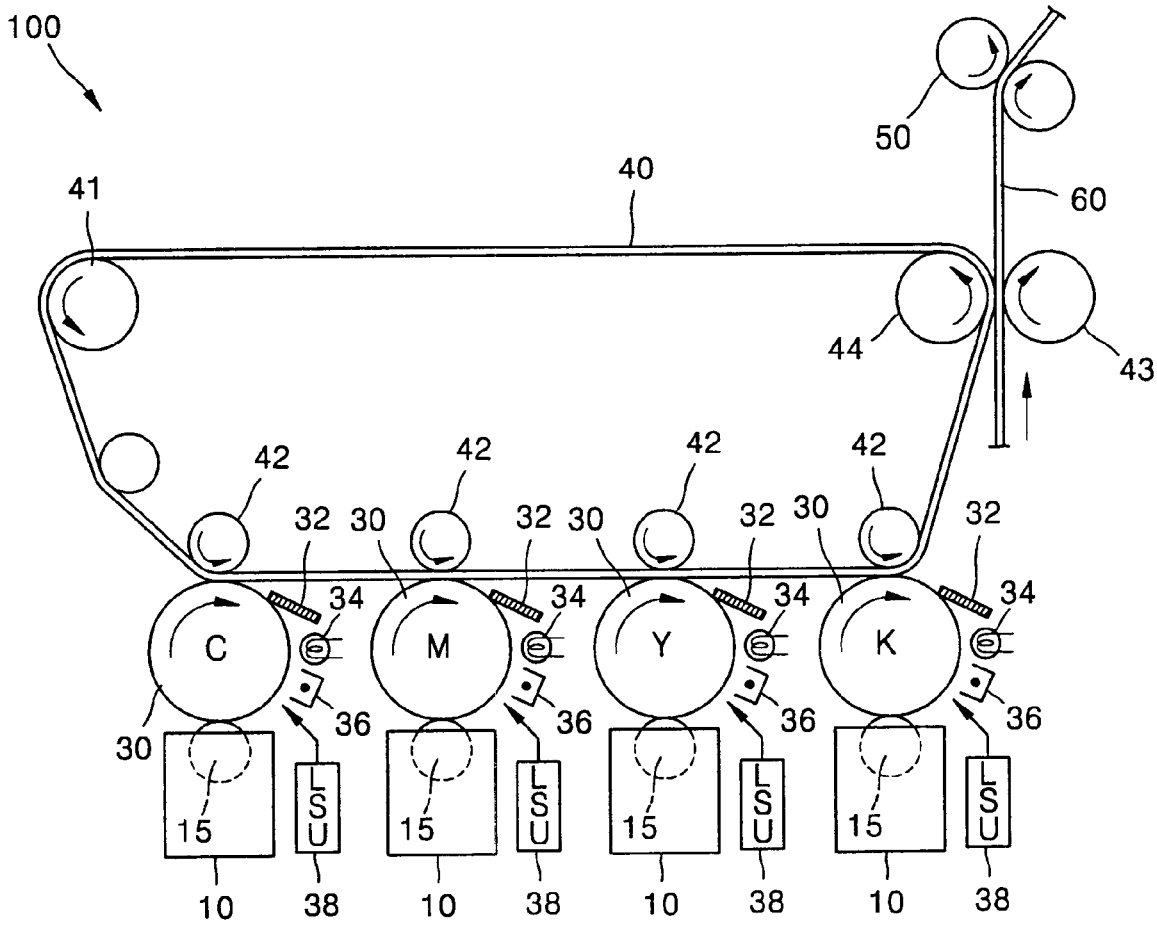
FIG. 1 (PRIOR ART)
FIG. 1 schematically shows the structure of a conventional liquid color image forming apparatus.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
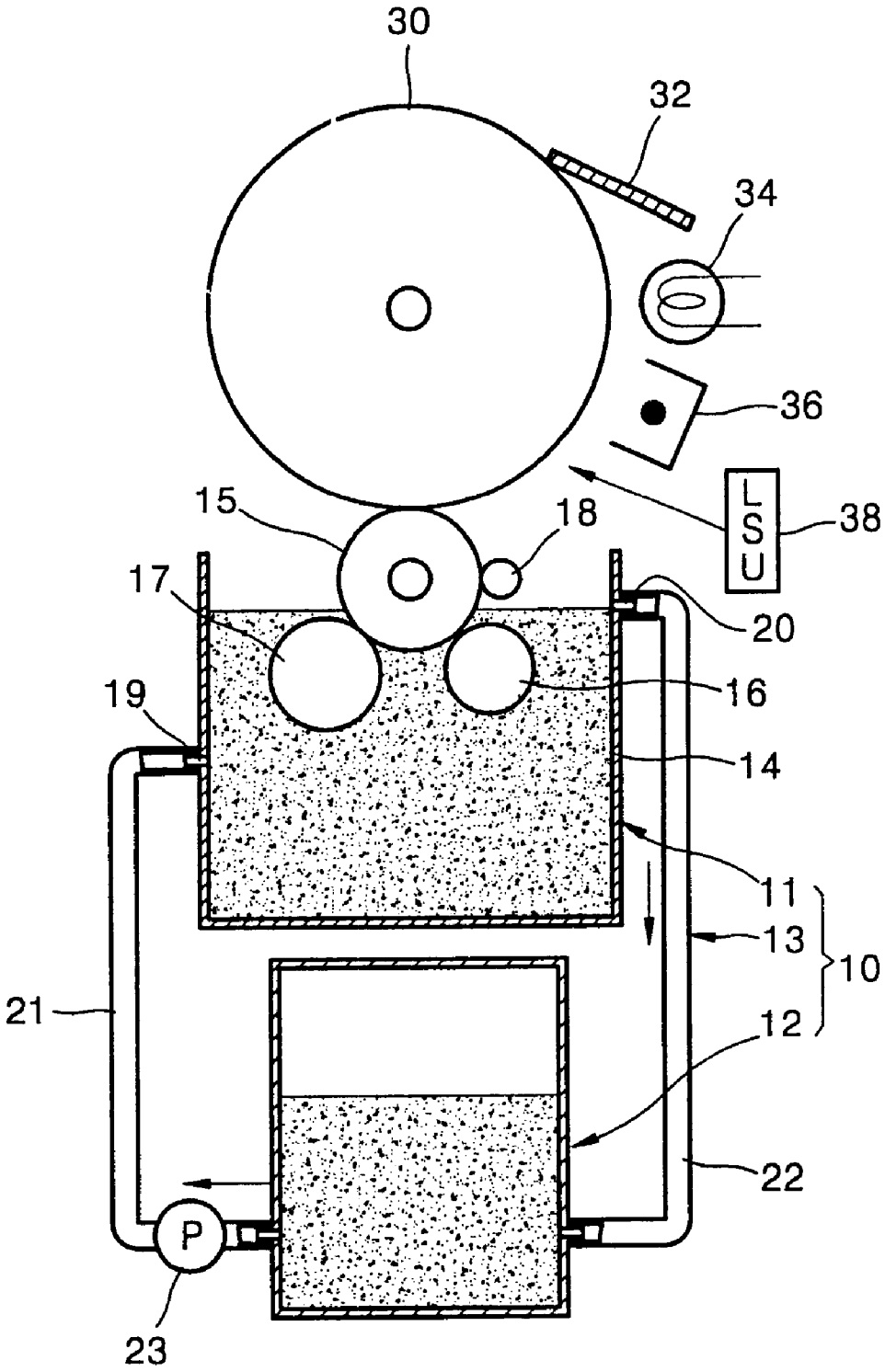
FIG. 2 (PRIOR ART)
FIG. 2 shows a detailed diagram of the image forming unit of FIG. 1.
Figure 3:
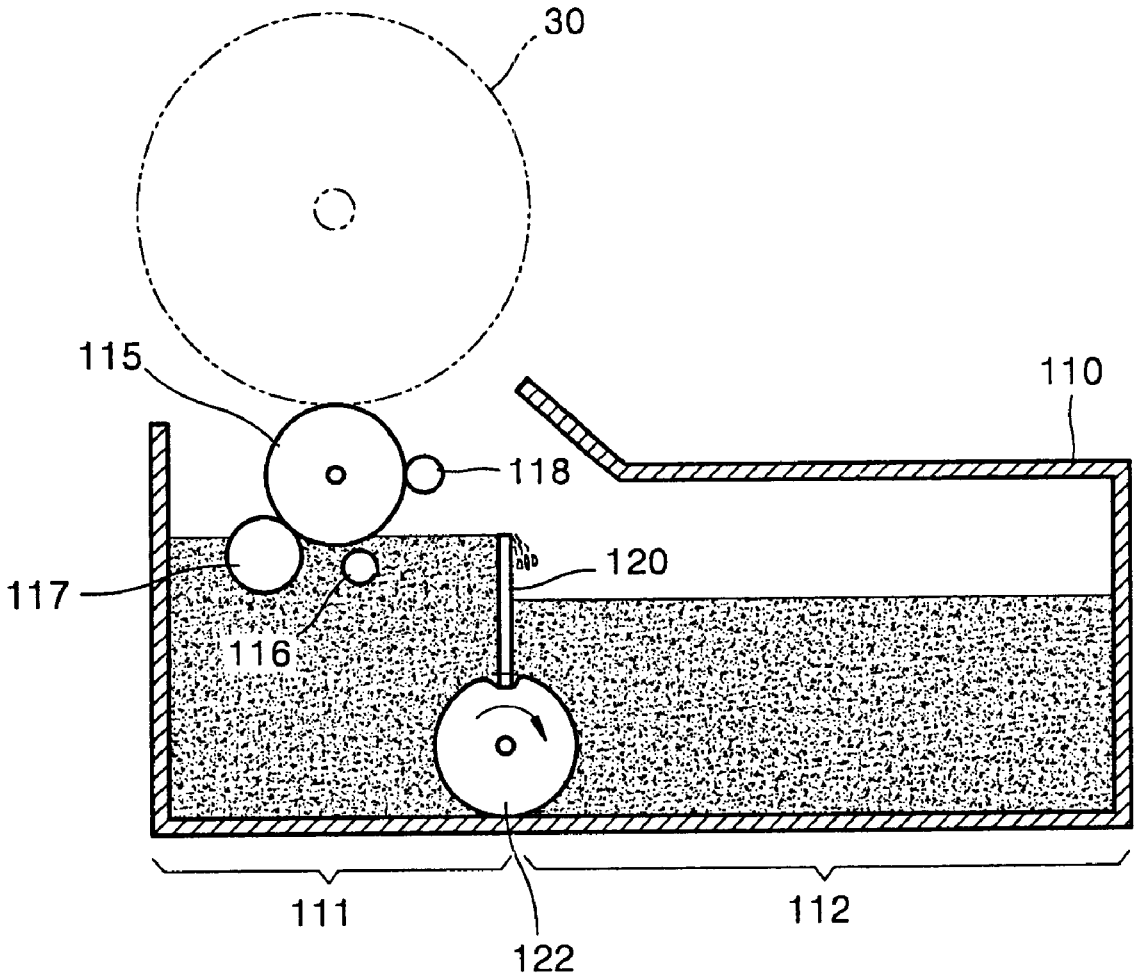
FIG. 3 shows a developing unit of a liquid image forming apparatus according to an embodiment of the present invention.

FIG. 3 shows a developing unit of a liquid image forming apparatus according to an embodiment of the present invention. The same names are used for the same elements as those in FIGS. 1 and 2, and the detailed descriptions thereof will be omitted.

Referring to FIG. 3, one barrier wall 120 is provided in a developing container 110 in which a developing agent is stored. The developing container 110 is divided into a developing portion 111 which develops a surface of a photosensitive drum 30 and an ink reservoir 112 in which ink supplied to the developing portion 111 is stored using the barrier wall 120.

The developing portion 111 includes a developing roller 115 installed to face the photosensitive drum 30, a depositing roller 116 which deposits a developing agent onto the surface of the developing roller 115, a metering roller 118 which regulates the amount of ink stuck onto an outer surface of the developing roller 115, and a cleaning roller 117.

A lower part of the barrier wall 120 is opened, and an ink supplying roller 122 is installed between the lower part of the barrier wall 120 and the bottom surface of the developing container 110. The ink supplying roller 122 in cooperation with the barrier wall 120 suppresses the flow of ink between the developing portion 111 and the ink reservoir 112. The outer surface of the ink supplying roller 122 is covered with an elastic porous material, e.g., sponge. When the ink supplying roller 122 is rotated, the sponge is compressed by the lower end of the barrier wall 120, as shown in FIG. 3. After the compressed portion of the ink supplying roller 122 passes through the lower end of the barrier wall 120 toward the ink reservoir 112, the compressed sponge is returned to its original state and absorbs ink in the ink reservoir 112. When the ink supplying roller 122 rotates, the ink supplying roller 122 meets the lower end of the barrier wall 120, and the sponge is compressed again, wherein the ink supplying roller 122 ejects and supplies ink to the developing portion 111.

The level of ink in the developing portion 111 should be uniform so that only a predetermined part of the developing roller 115 is dipped in the ink of the developing portion 111. Thus, a sufficient amount of ink should be supplied to the developing portion 111 by the ink supplying roller 122, and ink which exceeds a predetermined level in the developing portion 111 is withdrawn to the ink reservoir 112 along the upper part of the barrier wall 120.

The operation of the developing unit having the above structure will be described in detail with reference to the attached drawings.

The operation of the developing portion 111 will be described first. If an electrostatic latent image is formed on the photosensitive drum 30, the developing roller 115 rotates and develops the electrostatic latent image in a predetermined color by ink placed onto the surface of the developing roller 115. Subsequently, ink remaining on the surface of the developing roller 115 is removed by the cleaning roller 117. Subsequently, ink on the depositing roller 116, to which a predetermined voltage is applied, is transferred to the developing roller 115. The rotating developing roller 115 meets the metering roller 118, which removes excess ink from the developing roller 115, while ink less than a predetermined thickness remains on the developing roller 115. The remaining ink on the developing roller 115 performs a developing process.

Next, the operation of supplying ink to the developing portion 111 from the ink reservoir 112 will be described. From the bottom surface of the developing container 110, the ink supplying roller 122 rotates in a direction of the developing portion 111 from the ink reservoir 112. The rotating ink supplying roller 122 meets the lower end of the barrier wall 120 and is compressed to a predetermined depth, as shown in FIG. 3. The compressed ink supplying roller 122 is rotated toward the ink reservoir 112, is returned to its original state by a restoring force, and absorbs ink in the ink reservoir 112 into expanded pores. Subsequently, the ink supplying roller 122 again meets the lower end of the barrier wall 120, where the pores are contracted when the ink supplying roller 122 is compressed, and the ink supplying roller 122 ejects ink into the developing portion 111. Meanwhile, if a level of ink in the developing portion 111 is higher than the upper end of the barrier wall 120, ink goes over the barrier wall 120, and then is withdrawn to the ink reservoir 112. Thus, the ink within developing portion 111 is maintained at a uniform level.

Figure 4:
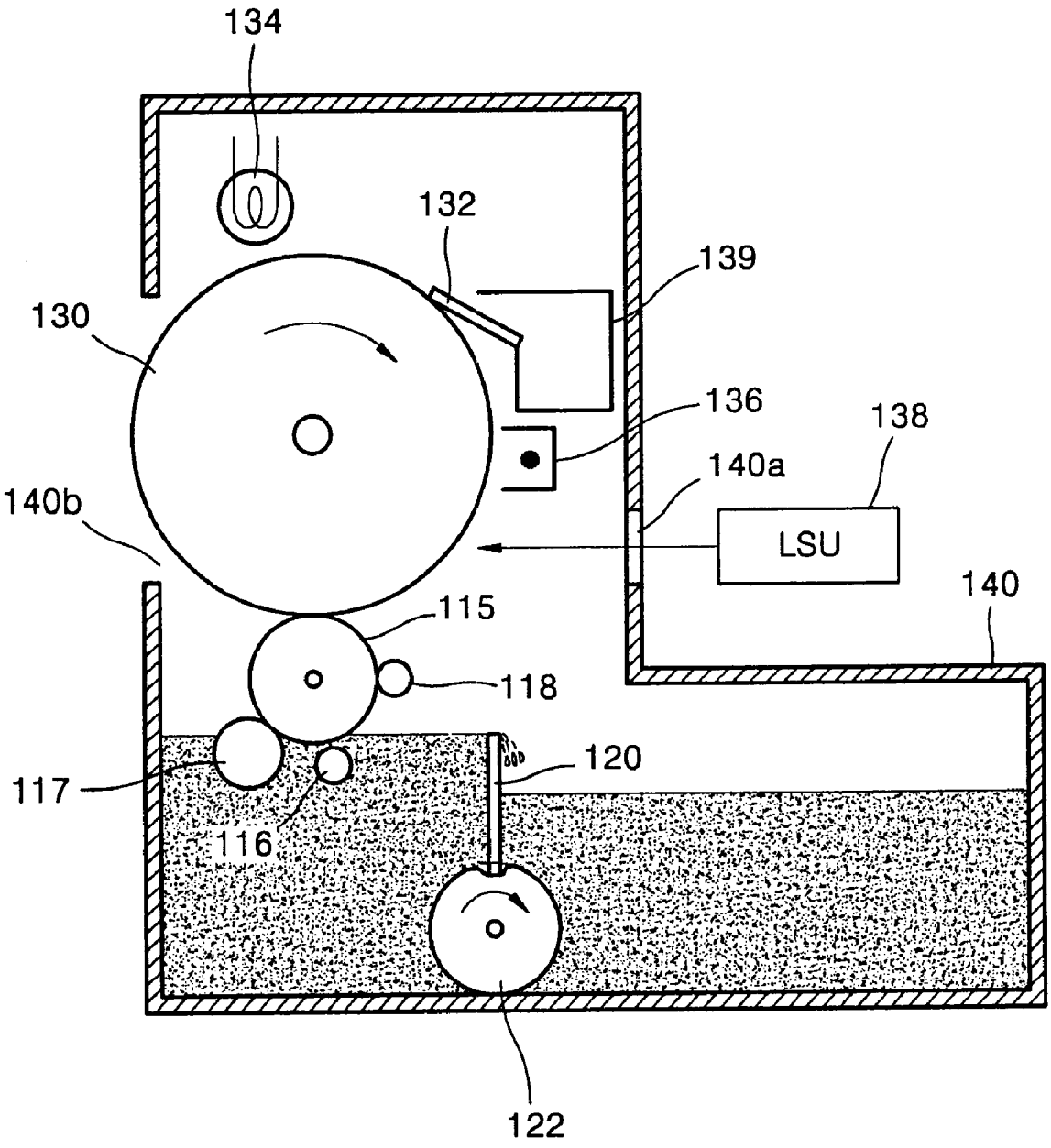
FIG. 4 schematically shows the structure of an image forming unit in which the developing unit of FIG. 3, a photosensitive drum, an eraser, and a charger are formed monolithically.

FIG. 4 schematically shows the structure of an image forming unit in which the developing unit of FIG. 3, a photosensitive drum, an eraser, and a charger are formed monolithically. The same reference numerals are used for the same elements as those in FIG. 3, and the detailed descriptions thereof will be omitted.

Referring to FIG. 4, in one cassette 140, the following are arranged: a photosensitive drum 130; a charger 136, which charges the photosensitive drum 130; a developing unit, which develops the electrostatic latent image; a cleaning blade 132, which removes toner on the photosensitive drum 130 after a transfer operation onto a transfer body is completed; and a container 139 in which toner removed by the cleaning blade 132 is withdrawn. A laser scanning unit (LSU) 138, which forms an electrostatic latent image on the charged photosensitive drum 130, is placed at one side of the cassette 140. The LSU 138 radiates light onto the photosensitive drum 130 via an open portion 140a formed at the side of the cassette 140.

Each of the above elements, except the LSU 138, are formed inside one monolithic cassette 140, and the cassette 140 can be replaced with another after being used for a predetermined amount of time. An opening 140*b* for the photosensitive drum 130 contacting the transfer body is formed at the other side of the image forming unit with respect to the open portion 140*a*. Thus, a plurality of image forming units to transfer color images onto the transfer body should be arranged in a vertical direction.

Further, although not shown, if the opening 140*b* is placed on the upper portion of the image forming unit, a plurality of image forming units can be arranged in a horizontal direction, as shown in FIG. 1.

The operation of the above structure will be described in detail with reference to the attached drawings.

First, the charger 136 charges the photosensitive drum 130 to a predetermined potential. Subsequently, the LSU 138 forms an electrostatic latent image on the surface of the charged photosensitive drum 130 via the opening 140*a*. The electrostatic latent image is developed by the developing roller 115 in a predetermined color. The surface potential of the photosensitive drum 130 is removed by the eraser 134 after the developed image is transferred onto a transfer body (not shown). Subsequently, toner remaining on the surface of the photosensitive drum 130 is removed by the cleaning blade 132, and then is withdrawn to the toner withdrawing container 139. The operations of the other structures are the same as those in the above embodiment, and thus will be omitted.

Figure 5:
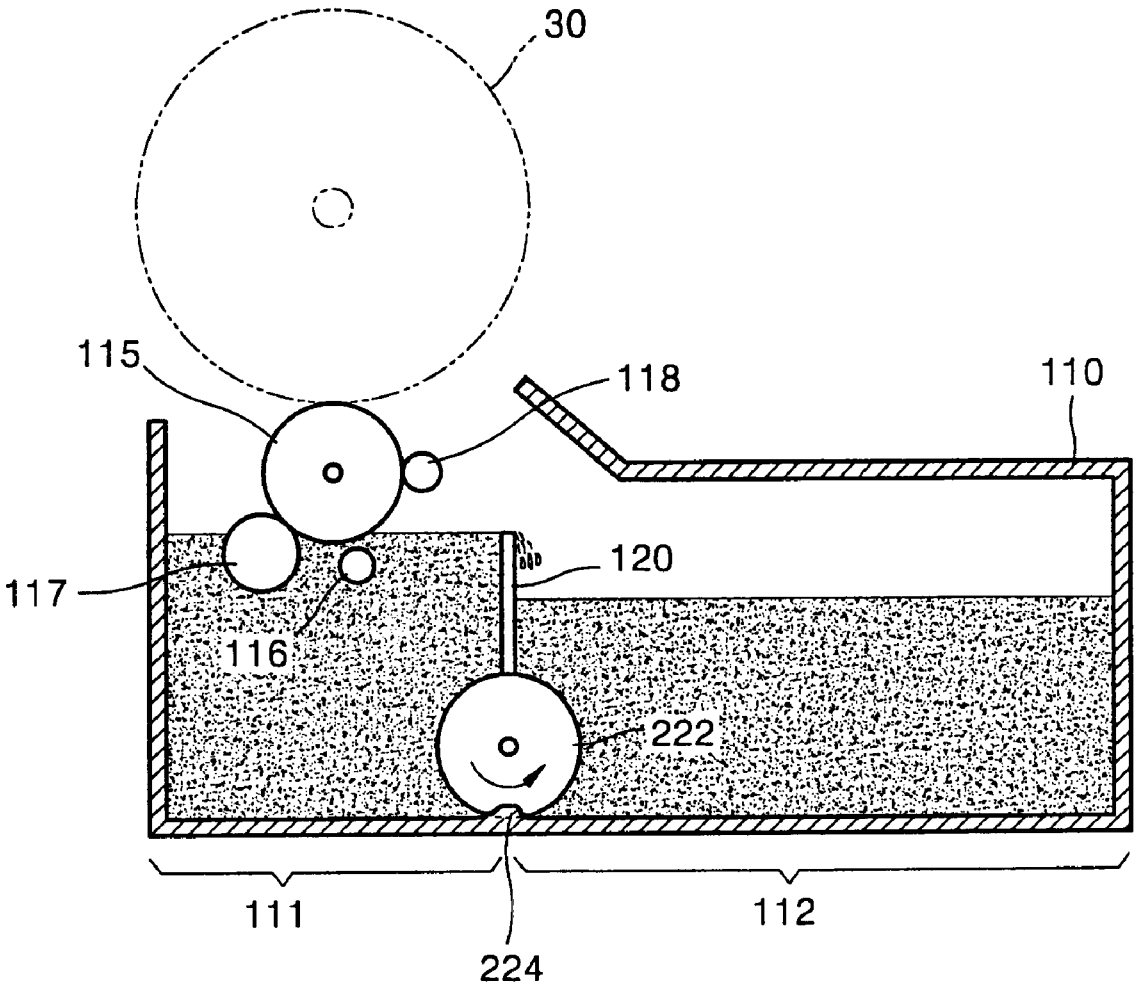
FIG. 5 shows the structure of a developing unit of the liquid image forming apparatus according to another embodiment of the present invention.

FIG. 5 shows the structure of the developing unit of the liquid image forming apparatus according to another embodiment of the present invention. The same reference numerals are used for the same elements as those in FIG. 3, and the detailed descriptions thereof will be omitted.

Referring to FIG. 5, one barrier wall 120 is vertically installed in a developing container 110 in which a developing agent is stored. The developing container 110 is divided into a developing portion 111 which develops a surface of a photosensitive drum 30, and an ink reservoir 112 in which ink supplied to the developing portion 111 is stored using the barrier wall 120.

A lower part of the barrier wall 120 is opened, and an ink supplying roller 222 is installed between the lower part of the barrier wall 120 and the bottom surface of the developing container 110. A protrusion 224, projected to correspond to the ink supplying roller 222 in a direction of the barrier wall 120, is formed on the bottom surface of the developing container 110 contacting the ink supplying roller 222. The outer surface of the ink supplying roller 222 is covered with an elastic porous material, e.g., sponge. The sponge is compressed at a portion where the ink supplying roller 222 meets the protrusion 224. The ink supplying roller 222 with the barrier wall 120 suppresses the movement of ink between the developing portion 111 and the ink reservoir 112. When the ink supplying roller 222 rotates, the sponge is compressed by the protrusion 224. After the compressed portion of the sponge passes through the protrusion 224, the compressed portion is returned to its original state and absorbs ink of the ink reservoir 112, thereby the ink supplying roller 122 ejects ink in the developing portion 111 when the portion of the ink supplying roller 122 is compressed.

The level of the developing portion 111 should be uniform so that only a predetermined part of the developing roller 115 is dipped in ink of the developing portion 111. Thus, a sufficient amount of ink should be supplied to the developing portion 111 by the ink supplying roller 222, and ink, which exceeds a predetermined level, is removed to the ink reservoir 112 along the upper part of the barrier wall 120.

The operation of supplying ink to the developing portion 111 from the ink reservoir 112 of the developing unit according to the above embodiment will be described in detail with reference to the attached drawings.

From the bottom surface of the developing container 110, the ink supplying roller 222 rotates in a direction of the ink reservoir 112 from the developing portion 111. The rotating ink supplying roller 222 meets the protrusion 224 and is compressed to a predetermined depth. The compressed portion of the ink supplying roller 222 is returned to its original state by a restoring force in the ink reservoir 112 and absorbs ink in the ink reservoir 112 into expanded pores. Subsequently, the ink supplying roller 222 again meets the protrusion 224 where the pores are contracted when the ink supplying roller 222 is compressed, and the ink-supplying roller 222 ejects ink into the developing portion 111. Meanwhile, if ink in the developing portion 111 exceeds a predetermined level, ink supplied excessively goes over the upper end of the barrier wall 120, and then is withdrawn to the ink reservoir 112. Thus, the developing portion 111 is maintained at a uniform level.

Figure 6:
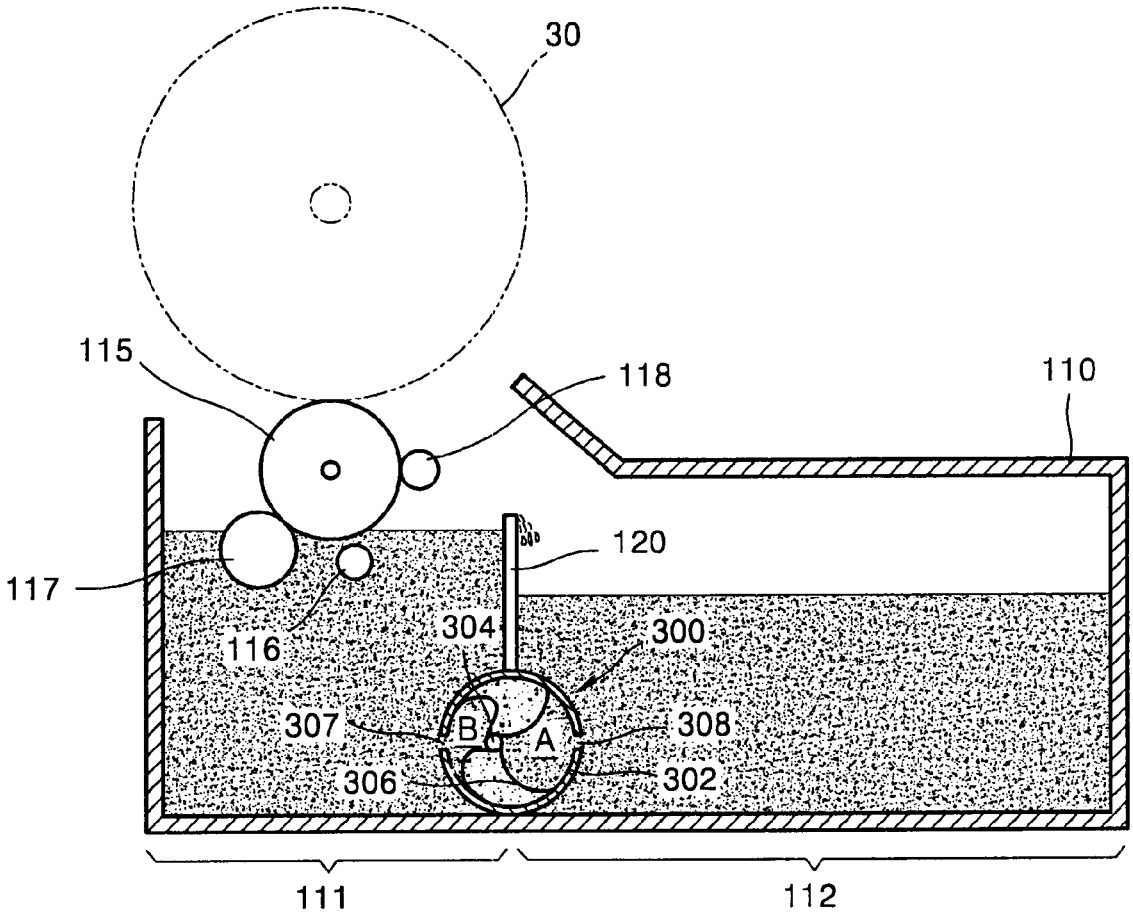
FIG. 6 shows the structure of a developing unit of the liquid image forming apparatus according to yet another embodiment of the present invention.

FIG. 6 shows the structure of the developing unit of the liquid image forming apparatus according to another embodiment of the present invention. The same reference numerals are used for the same elements as those in FIG. 3, and the detailed descriptions thereof will be omitted.

Referring to FIG. 6, a barrier wall 120 is vertically installed in a developing container 110 in which a developing agent is stored. The developing container 110 is divided into a developing portion 111, which develops a surface of a photosensitive drum 30, and an ink reservoir 112 in which ink supplied to the developing portion 111 is stored using the barrier wall 120.

A lower part of the barrier wall 120 is opened, and an eccentric ink supplying pump 300 is provided between the lower part of the barrier wall 120 and the bottom surface of the developing container 110. The eccentric ink supplying pump 300 includes a casing 302, an eccentric axis 304, and a plurality of impellers 306. Upper and lower parts of the casing 302 are fixed at the lower end of the barrier wall 120 and inside the developing container 110, respectively. Openings 307 and 308, each of which faces the developing portion 111 and the ink reservoir 112, respectively, are formed at opposite sides of the casing 302. The eccentric axis 304 is eccentric in the casing 302 in a direction of the developing portion 111. The plurality of impellers 306 equally spaced apart from one another are connected to the eccentric axis 304. Preferably, the plurality of impellers 306 are formed of a flexible material, such as urethane rubber.

The operation of supplying ink to the developing portion 111 from the ink reservoir 112 of the developing unit according to the above embodiment will be described in detail with reference to the attached drawings.

When the ink supplying pump 300 rotates in a clockwise direction of FIG. 6, the impellers 306, connected to the eccentric axis 304, are bent to be opposite to a rotation direction in the casing 302, seal the casing 302, and rotate. The impellers 306 are spaced apart from one another by a uniform interval. The volume A between the two impellers 306 at the opening 308 having a large interval between the eccentric axis 304 and the casing 302 is larger than the volume B between the two impellers 306 at the opening 307 having a small interval between the eccentric axis 304 and the casing 302. Thus, ink sucked between the two impellers 306 at the opening 308 connected to the ink reservoir 112 rotates such that at the opening 307 having a smaller volume between the two impellers 306, ink of a difference between the volumes A and B is ejected to the developing portion 111. Meanwhile, if ink in the developing portion 111 exceeds a predetermined level, ink supplied excessively goes over the upper end of the barrier wall 120, and then is withdrawn to the ink reservoir 112. Thus, the developing portion 111 is maintained at a uniform level.

As described above, in the liquid image forming apparatus according to the present invention, the developing portion and the ink reservoir are simply formed as one unit, and thus parts and space required for the circulating portion which circulates ink between the developing portion and the ink reservoir can be reduced, thereby simplifying the structure of a liquid printer and fundamentally solving clogging problems in the circulating portion. In addition, the image forming unit including the photosensitive drum is manufactured as one cassette, thereby easily being replaced with another one when a life span thereof is terminated.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A liquid image forming apparatus comprising:

a developing portion in which a developing roller to develop an electrostatic latent image formed on a photosensitive body in a predetermined color is installed and which is maintained at a uniform level so that the developing roller is dipped at a predetermined level;

an ink reservoir in which ink supplied to the developing portion is stored; and an ink supplying unit that supplies ink stored in the ink reservoir to the developing portion, the ink supplying unit comprising:

a developing container, a barrier wall by which the developing container is divided into the developing portion and the ink reservoir and a lower part of which is opened, and an ink supplying roller which is installed to contact the lower part of the barrier wall and a bottom surface of the developing container and supplies ink in the ink reservoir to the developing portion, wherein the developing portion and the ink reservoir are provided in the developing container.

2. The apparatus of claim 1, wherein the ink supplying roller is compressed by a lower end of the barrier wall, passes through the lower end of the barrier wall, is expanded, absorbs ink in the ink reservoir, meets the lower end of the barrier wall and is compressed when rotating, and ejects ink in the developing portion.

3. The apparatus of claim 2, wherein the ink supplying roller is rotated toward the developing portion from the ink reservoir at a portion where the ink supplying roller meets the bottom surface of the developing container.

4. The apparatus of claim 1, further comprising a protrusion which projects to correspond to the ink supplying roller in a direction of the barrier wall and is formed to compress an outer surface of the ink supplying roller on the bottom surface of the developing container contacting the ink supplying roller, and wherein the ink supplying roller passes through the protrusion, is swollen, absorbs ink in the ink reservoir, meets the protrusion and is compressed when rotating, and ejects ink into the developing portion.

5. The apparatus of claim 4, wherein the ink supplying roller is rotated toward the ink reservoir from the developing portion at a portion where the ink supplying roller meets the protrusion of the developing container.

6. The apparatus of claim 1, wherein an elastic porous material is formed on the outer surface of the ink supplying roller.

7. The apparatus of claim 6, wherein the porous material is sponge.

8. The apparatus of claim 1, further comprising:

a photosensitive drum on which an electrostatic latent image developed by the developing roller is formed;

an eraser which erases an electric potential on the photosensitive drum; and an exposing unit which forms an electrostatic latent image on the erased photosensitive drum;

wherein said elements are provided in the developing container and form one image forming unit.

9. The apparatus of claim 8, further comprising:

a cleaning blade which removes waste toner on the photosensitive drum; and a toner withdrawing container in which toner removed by the cleaning blade is stored.

10. A liquid image forming apparatus comprising:

a developing portion in which a developing roller that develops an electrostatic latent image formed on a photosensitive body in a predetermined color is installed and which is maintained at a uniform level so that the developing roller is dipped at a predetermined level;

an ink reservoir in which ink supplied to the developing portion is stored; and an ink supplying unit that supplies ink stored in the ink reservoir to the developing portion;

wherein the developing portion and the ink reservoir are provided in one developing container, and the ink supplying unit comprises:

a barrier wall dividing the developing container into the developing portion and the ink reservoir and having an opened lower part;

a cylindrical casing, upper and lower parts of which are fixed between the lower part of the barrier wall and a bottom surface of the developing container, having openings at both sides formed to face the developing portion and the ink reservoir, respectively;

an axis eccentric in the cylindrical casing; and a plurality of impellers, one end of each impeller being fixed on the eccentric axis.

11. The apparatus of claim 10, wherein the eccentric axis is eccentric in the cylindrical casing in a direction of the developing portion.

12. The apparatus of claim 10, wherein the impeller is formed of elastic rubber.

13. The apparatus of claim 10, wherein the impellers are rotated toward the developing portion from the ink reservoir at a portion where the impellers meet the bottom surface of the cylindrical casing.

14. The apparatus of claim 2, wherein an elastic porous material is formed on the outer surface of the ink supplying roller.

15. The apparatus of claim 4, wherein an elastic porous material is formed on the outer surface of the ink supplying roller.

16. The apparatus of claim 2, further comprising:

a photosensitive drum on which an electrostatic latent image developed by the developing roller is formed;

an eraser which erases an electric potential on the photosensitive drum; and an exposing unit which forms an electrostatic latent image on the erased photosensitive drum;

wherein the photosensitive body and the developing roller are provided in the developing container and form one image forming unit.

17. The apparatus of claim 4, further comprising:

a photosensitive drum on which an electrostatic latent image developed by the developing roller is formed;

an eraser which erases an electric potential on the photosensitive drum; and an exposing unit which forms an electrostatic latent image on the erased photosensitive drum;

wherein the photosensitive body and the developing roller are provided in the developing container and form one image forming unit.

18. The apparatus of claim 13, wherein the impellers are bent to be opposite to a rotation direction of the cylindrical casing.

19. The apparatus of claim 13, wherein the impellers are spaced apart from one another by a uniform interval such that a first volume within the cylindrical casing opposite to the side in which the axis is eccentric is larger than a second volume within the cylindrical casing in which the axis is eccentric, such that the difference in ink contained in the first and second volumes is ejected into the developing portion.

20. A developing unit comprising;

a developing roller;

an ink developing container including:

a developing portion to supply ink to the developing roller; and an ink reservoir to contain excess ink, and an ink supplying unit dividing the developing portion and the ink reservoir such that the ink supplying unit absorbs ink in the ink reservoir and ejects the absorbed ink into the developing portion to maintain the ink within the developing portion at a uniform level, wherein the ink supplying unit comprises:

a supplying roller absorbing and ejecting ink; and a barrier wall compressing and expanding the supplying roller such that ink is ejected from the supplying roller when compressed and absorbed into the supplying roller when expanded.

21. The developing unit of claim 20, wherein the barrier wall is positioned in the ink developing container such that ink within the developing portion above a predetermined level passes over the barrier wall and flows back into the ink reservoir.

22. A developing unit comprising;

a developing roller;

an ink developing container including:

a developing portion to supply ink to the developing roller; and an ink reservoir to contain excess ink, and an ink supplying unit dividing the developing portion and the ink reservoir such that the ink supplying unit absorbs ink in the ink reservoir and ejects the absorbed ink into the developing portion to maintain the ink within the developing portion at a uniform level, wherein the ink supplying unit comprises:

a supplying roller absorbing and ejecting ink;

a protrusion compressing and expanding the supplying roller such that ink is ejected from the supplying roller when compressed and absorbed into the supplying roller when expanded; and a barrier wall to keep ink within the developing portion at a uniform level.

23. The developing unit of claim 22, wherein the barrier wall is positioned in the ink developing container such that ink within the developing portion above a predetermined level passes over the barrier wall and flows back into the ink reservoir.

* * * * *